US009249585B1

(12) United States Patent
Swindle

(10) Patent No.: US 9,249,585 B1
(45) Date of Patent: Feb. 2, 2016

(54) DOOR TRIM FLOOR GAP COVER SYSTEM

(71) Applicant: Jerry Wayne Swindle, Hermitage, TN (US)

(72) Inventor: Jerry Wayne Swindle, Hermitage, TN (US)

( * ) Notice: Subject to any disclaimer, the term of this patent is extended or adjusted under 35 U.S.C. 154(b) by 0 days.

(21) Appl. No.: 14/252,547

(22) Filed: Apr. 14, 2014

Related U.S. Application Data

(60) Provisional application No. 61/811,521, filed on Apr. 12, 2013.

(51) Int. Cl.
*E04F 19/04* (2006.01)
*E06B 1/34* (2006.01)

(52) U.S. Cl.
CPC ..... *E04F 19/0495* (2013.01); *E06B 1/34* (2013.01)

(58) Field of Classification Search
CPC ..... E04F 19/0495; E04F 19/061; E06B 1/34; E06B 1/62; E06B 2001/622; E06B 1/52
USPC ..... 52/211–217, 716.1, 717.01
See application file for complete search history.

(56) References Cited

U.S. PATENT DOCUMENTS 3,130,455 A * 4/1964 Borlenghi ..... E06B 1/32 49/504
3,385,004 A * 5/1968 Oehler ..... E06B 1/6015 49/504
3,401,487 A * 9/1968 Brandt ..... E06B 1/20 49/504
3,545,135 A * 12/1970 Lieber ..... E06B 1/30 16/375
5,203,130 A * 4/1993 Freelove ..... E06B 1/30 52/211
D545,649 S * 7/2007 Speck ..... D8/15

* cited by examiner

*Primary Examiner* — Brian Glessner
*Assistant Examiner* — Adam Barlow
(74) *Attorney, Agent, or Firm* — Mark A. Pitchford; Waller Lansden Dortch & Davis

(57) ABSTRACT

A door trim floor gap cover system includes a trim piece operable to cover a gap between a bottom edge of door trim and a walking surface of a flooring material under the door trim (i.e., casing, jamb, and optional door stop). The trim piece may be one piece that bends about the door trim. The trim piece may be a resilient material that deforms while being positioned and is biased toward its original shape to hold onto the door casing. The trim piece may be more than one piece wherein a first portion is positioned on the casing and jamb and the second portion is then interlocked with the first portion to complete the trim piece, covering the floor gap. A pair of hooks extend behind the casing to engage a distal face of the casing, retaining the system against the door trim (casing and jamb).

13 Claims, 7 Drawing Sheets

DOOR TRIM FLOOR GAP COVER SYSTEM

CROSS-REFERENCES TO RELATED APPLICATIONS

This application claims priority to and hereby incorporates by reference in its entirety U.S. Provisional Patent Application Ser. No. 61/811,521 entitled "Metal ornamental piece that makes a clean transition from door casing to floor, Casing Plate" filed on Apr. 12, 2013.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to interior trim work in buildings. More particularly, this invention pertains to trimming door casings, jambs and stops.

Various flooring materials have different thicknesses. For example, hardwood flooring has a thickness of about ¾", vinyl flooring has a thickness of about ⅛", laminate flooring has a thickness of about ½", and tile has an overall thickness of about ½" (i.e., raises the walking surface approximately ½" above the top of the subfloor). When trimming hardwood, vinyl, laminate, or tile along a wall, a baseboard is laid along the wall above the walking surface of the flooring material (approximately 1" above the subfloor), and quarter round is put down to close the gap between the bottom of the baseboard and the walking surface of the flooring material.

Carpet has an actual thickness of about ⅜", but can fill gaps up to 1" under baseboards and other trim work. Carpet is typically not trimmed with quarter round because the carpet covers the bottom edge of the baseboard and door trim (i.e., door casing, jamb, and/or door stop) along the edges of the room. One popular renovation is to change common areas of residential dwellings from carpet to hardwood or tile. In areas with baseboard, the addition of quarter round covers the gap between the bottom edge of the baseboard and the walking surface of the new flooring material. However, around door trim (i.e., door casing, jamb, and/or stop), a gap of about ¼" to ½" exists between the bottom of the door trim the walking surface (i.e., top) of the new flooring material. Caulk cannot be used to fill a gap this large, and replacing the door casing with one that extends from the top of the door opening to the walking surface of the flooring material involves removing all of the current door trim (i.e., casing, jamb, and stop if any) and hanging a new door with trim. Installing a new door and trim to achieve an extension of the door trim down to the walking surface of the flooring material is cost prohibitive. This same situation arises when there is a change order regarding the flooring material during construction or a door casing is simply cut too short during installation. Further, the situation is compounded when the gap may be uneven because the flooring material changes at the doorway. That is, new hardwood replacing carpet that previously met hardwood in the doorway typically has a wider gap than on the side of the doorway with the preexisting hardwood because the door trim was cut to fit hardwood on one side and carpet on the other when the doorway and flooring were originally installed.

BRIEF SUMMARY OF THE INVENTION

Aspects of the present invention provide a door trim floor gap cover system including a trim piece operable to cover a gap between a bottom edge of door trim and a walking surface of a flooring material under the door trim (i.e., casing, jamb, and optional door stop). The trim piece may be one piece that bends about the door trim. The trim piece may be a resilient material that deforms while being positioned and is biased toward its original shape to hold onto the door casing. The trim piece may be more than one piece wherein a first portion is positioned on the casing and jamb and the second portion is then interlocked with the first portion to complete the trim piece, covering the floor gap. Each of a pair of hooks extends behind the casing to engage a distal face of the casing, retaining the system against the door trim (casing and jamb).

In one aspect, a. door trim floor gap cover system is configured to cover a gap between a bottom of a door trim and a walking surface of a flooring material under the door trim when installed on the door trim. The system includes a center portion, a first longitudinal portion, a second longitudinal portion, a first hook, and a second hook. The center portion extends laterally and is configured to extend along an outer face of a jamb of the door trim. The first longitudinal portion extends generally longitudinally from a first end of the center portion and is configured to extend along an outer face of a first casing of the door trim. The second longitudinal portion extends generally longitudinally from a second end of the center portion and is configured to extend along an outer face of a second casing of the door trim. The first hook extends longitudinally beyond the first longitudinal portion and generally inward toward the second longitudinal portion such that the first hook engages a distal face of the first casing when the system is installed on the door trim. The second hook extends longitudinally beyond the second longitudinal portion and generally inward toward the first longitudinal portion such that the second hook engages a distal face of the second casing when the system is installed on the door trim.

In another aspect, a method of installing a door trim floor gap cover system on a door trim to cover a gap between a bottom of the door trim and a walking surface of a flooring material under the door trim includes positioning an inner face of a first interlocking section of a center portion of the system against an outer face of a jamb of the door trim such that an inner face of a first longitudinal portion of the system contacts an outer face of a first casing of the door trim, a bottom of the first interlocking section contacts the walking surface of the flooring material, and a first hook of the system engages a distal face of the first casing. The first interlocking section of the center portion has a recess or protrusion adjacent a lateral edge of the first interlocking section. The center portion extends laterally when the system is installed on the door trim. The first longitudinal portion extends generally longitudinally from a first end of the center portion when the system is installed on the door trim and is configured to extend along the outer face of the first casing of the door trim when the system is installed on the door trim. The first hook extends longitudinally beyond the first longitudinal portion and generally toward a second longitudinal portion of the system when the system is installed on the door trim. The method continues with positioning an inner face of a second interlocking section of the center portion of the system against the outer face of the jamb of the door trim such that an inner face of the second longitudinal portion of the system contacts an outer face of a second casing of the door trim, a second hook of the system engages a distal face of the second casing, and the second interlocking section is not in contact with the walking surface of the flooring material. The second interlocking section of the center portion has a recess or protrusion adjacent a lateral edge of the second interlocking section and the recess or protrusion of the second interlocking section is substantially complementary to the recess or protrusion of the first interlocking section. The second longitudinal portion extends generally longitudinally from a second end of the center portion when the system is installed on the door trim and is configured to extend along the outer face of the second casing of the door trim when the system is installed on the door trim. The second hook extends generally longitudinally beyond the first longitudinal portion and generally toward the first longitudinal portion of the system when the system is installed on the door trim. The second interlocking section is then lowered to the walking surface of the flooring material such that the recess or protrusion of the first interlocking section interlocks with the complementary recess or protrusion of the second interlocking section.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
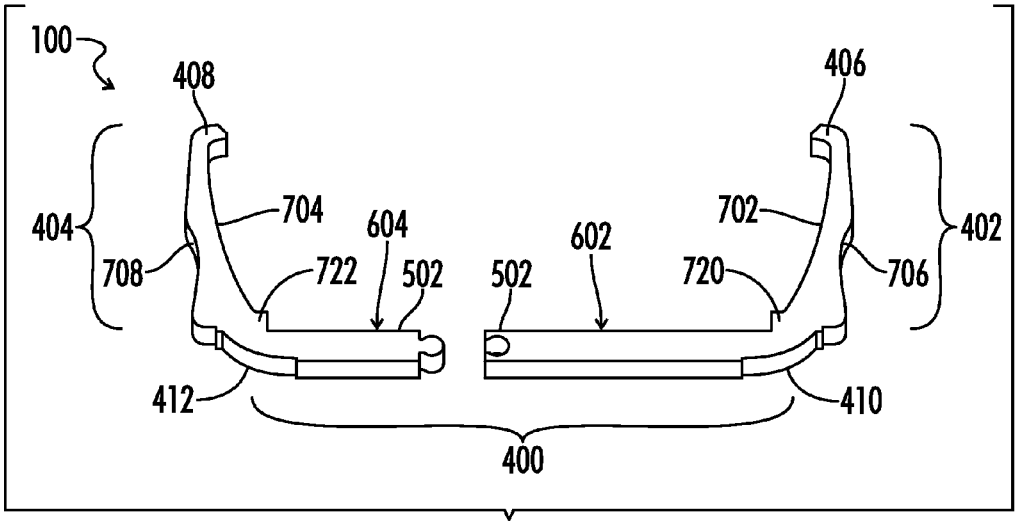
FIG. 1 is an isometric view of a system for covering a door trim floor gap.
Figure 2:
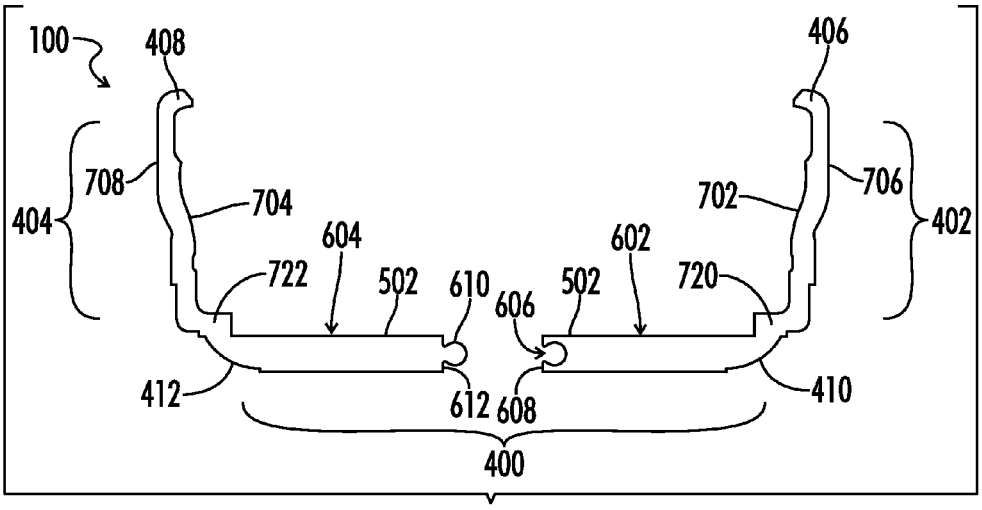
FIG. 2 is a top plan view of the system of FIG. 1 wherein the system is separated into two pieces at an interlocking joint of the system.
Figure 3:
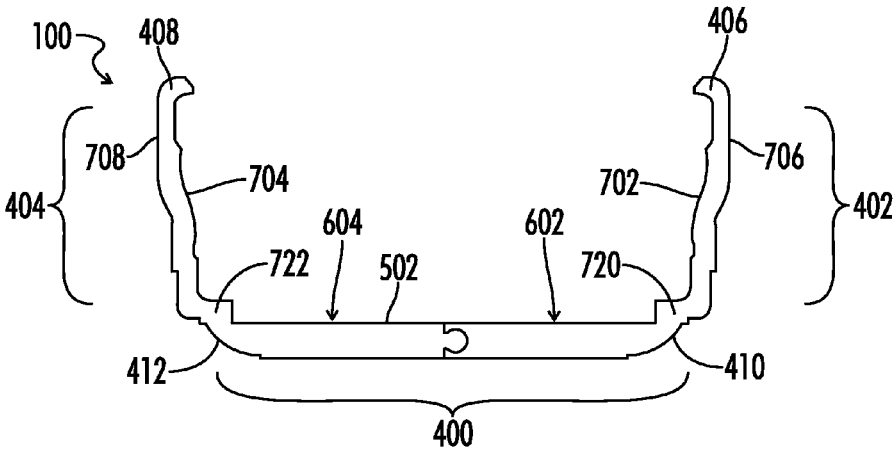
FIG. 3 is a top plan view of the system of FIGS. 1 and 2 wherein the system the interlocking joint is assembled.
Figure 4:
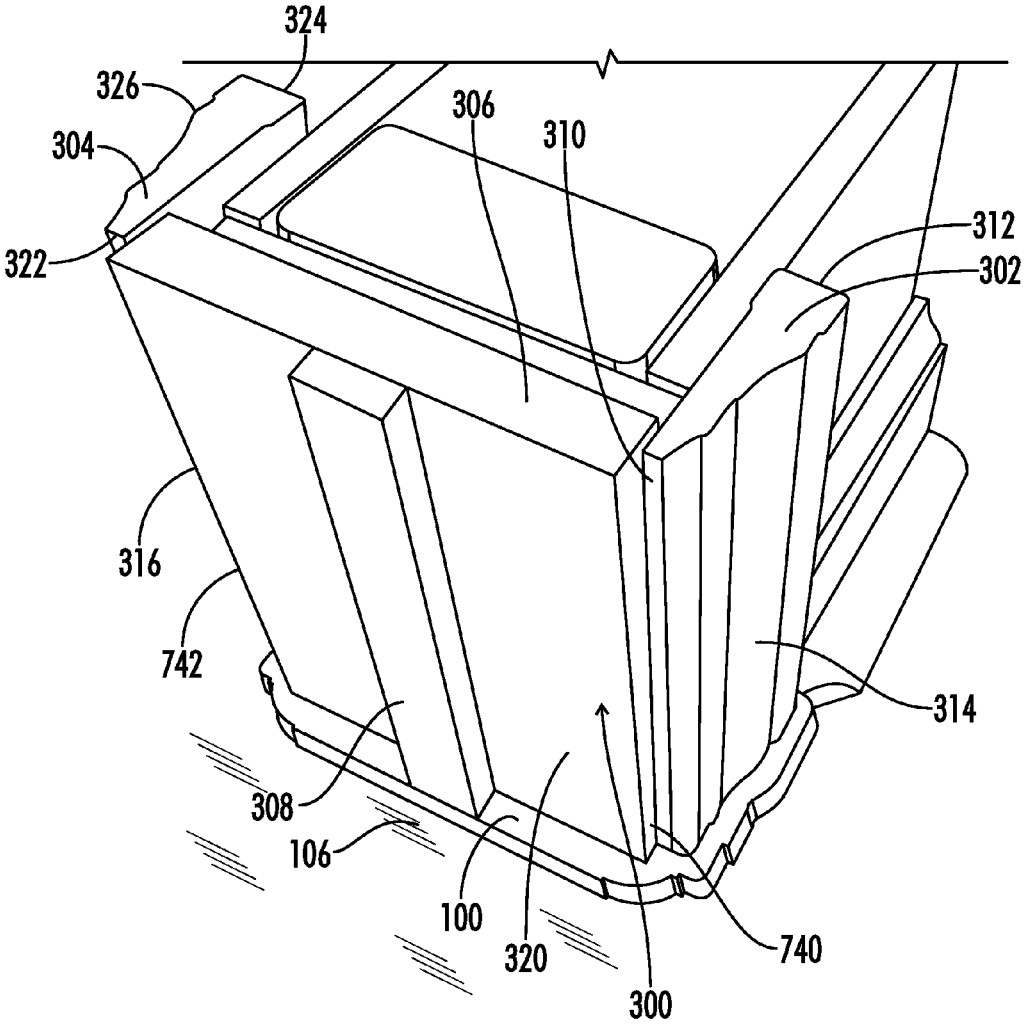
FIG. 4 is a cutaway isometric view of a doorway showing door trim components.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation or use unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Referring to FIGS. 1-5, a door trim floor gap cover system 100 is configured to cover a gap 102 (see FIG. 5) between a bottom 104 of a door trim 300 and a walking surface 106 of a flooring material under the door trim 300. The door trim 300 includes a first casing 302, a second casing 304, and a jamb 306. Optionally, the door trim 300 may also include a doorstop 308. The first casing 302 has a proximal face 310, a distal face 312, and an outer face 314 having a profile. The jamb 306 has a first lateral end 316, a second lateral end 318, and an outer face 320. The second casing 304 is a proximal face 322, a distal face 324, and an outer face 326 having a profile.

The system 100 includes a center portion 400, a first longitudinal portion 402, a second longitudinal portion 404, a first hook 406, and a second hook 408. The center portion 400 extends laterally and is configured to extend along the outer face 320 of the jamb 306. The first longitudinal portion 402 extends generally longitudinally from a first end 410 of the center portion 400 and is configured to extend along the outer face 314 of the first casing 302. The second longitudinal portion 404 extends generally longitudinally from a second end 412 of the center portion 300 opposite the first end 410 of the center portion 400 and is configured to extend along the outer face 326 of the second casing 304. The first hook 406 extends longitudinally beyond the first longitudinal portion 402 and generally inward toward the second longitudinal portion 404 (e.g., toward the second hook 408) such that the first hook 406 engages the distal face 312 of the first casing 302 when the system 100 is installed on the door trim 300. The second hook 408 extends longitudinally beyond the second longitudinal portion 404 and generally inward toward the first longitudinal portion 402 (e.g., toward the first hook 406) such that the second hook 408 engages the distal face 324 of the second casing 304 when the system 100 is installed on the door trim 300. In one embodiment, the first hook 406 and second hook 408 cooperate to at least partially hold an inner face 502 of the center portion 400 against the outer face 320 of the jamb 306. In another embodiment, the inner face 502 of the center portion 400 is maintained at a relatively small distance (e.g., less than ⅛") from the outer face 320 of the jamb 306. As described herein, the latitudinal and longitudinal directions are substantially horizontal and parallel with the floor walking surface 106 when the system 100 is installed on the door trim 300. The vertical direction is perpendicular to the latitudinal and longitudinal directions. In one embodiment, the center portion 400 has a longitudinal depth of approximately ⅜". In one embodiment, the center portion 400 has a vertical height of approximately ⅝". In one embodiment, the first longitudinal portion 402 is integral with the center portion 400, and the second longitudinal portion 404 is integral with the center portion 400. In one embodiment, the first hook 406 is integral with the first longitudinal portion 402, and the second hook 408 is integral with the second longitudinal portion 404.

In one embodiment, the center portion 400 of the system 100 includes 2 interlocking sections. Each interlocking section has a lateral edge where the 2 interlocking sections interlock with one another. The lateral edges of the 2 interlocking sections may be offset from a center of the center portion 400 by at least ¾". In one embodiment, the center portion 400 includes a first interlocking section 602 and a second interlocking section 604. The first interlocking section 602 has a recess 606 extending vertically through the first interlocking section 602 adjacent a lateral edge 608 of the first interlocking section 602. The second interlocking section 604 has a protrusion 610 extending vertically across the second interlocking section 604 from a lateral edge 612 of the second interlocking section 604. The protrusion 610 is generally complementary to the recess 606 such that the recess 606 is operable to receive the protrusion 610, and the lateral edge 608 of the first interlocking section 602 and the lateral edge 612 of the second interlocking section 604 engage one another. In one embodiment, the recess 606 and the protrusion 610 are substantially cylindrical. In another embodiment, the recess 606 and the protrusion 610 have a substantially triangular cross-section. It is contemplated that the interlocking joint formed by the recess 606 and protrusion 610 may be in either the first longitudinal portion 402 or second longitudinal portion 404. It is also contemplated that the recess 606 may be formed in the second interlocking section 604 while the protrusion 610 is formed on the first interlocking portion 602 within the scope of the claims.

Walls are typically made with either 2×4 construction or 2×6 construction. To adapt a system 100 designed for a 2×4 wall to a 2×6 wall, the center portion 400 may include an extension. The extension has vertical height and longitudinal depth equal to a vertical height and longitudinal depth of the rest of the center portion 400. The extension has a first end having an adjacent recess, and a second end having an adjacent protrusion. The recess of the extension corresponds to the recess 606 of the first interlocking section 602, and the protrusion of the extension corresponds to the protrusion 610 of the second interlocking section 604. In one embodiment, the extension is approximately 2 inches from the first end to the second end.

In one embodiment, the outer face 314 of the first casing 302 of the door trim 300 has a profile, and the first longitudinal portion 402 has an inner face 702 with a profile generally complementary to the profile of the outer face 314 of the first casing 302. In one embodiment, the first longitudinal portion 402 has an outer face 706 having a profile generally matching the profile of the outer face 314 of the first casing 302. In one embodiment, the outer face 326 of the second casing 304 of the door trim 300 has a profile, and the second longitudinal portion 404 has an inner face 704 with a profile generally complementary to the profile of the outer face 326 of the second casing 304 of the door trim 300. In one embodiment, the second longitudinal portion 404 has an outer face 708 having a profile generally matching the profile of the outer face 326 of the second casing 304.

In one embodiment, the system 100 further includes a first filler section 720, and a second filler section 722. The first filler section 720 is located where the first longitudinal portion 402 meets the center portion 400. First filler section 720 is configured to a butt a first lateral face 740 of the jamb 306 and the proximal face 310 of the first casing 302 of the door trim 300. The second filler section 722 is located where the second longitudinal portion 404 meets the center portion 400, and the second filler section 722 is configured to a butt a second lateral face 742 of the jamb 306 of the door trim 300 and the proximal face 322 of the second casing 304 of the door trim 300.

Figure 5:
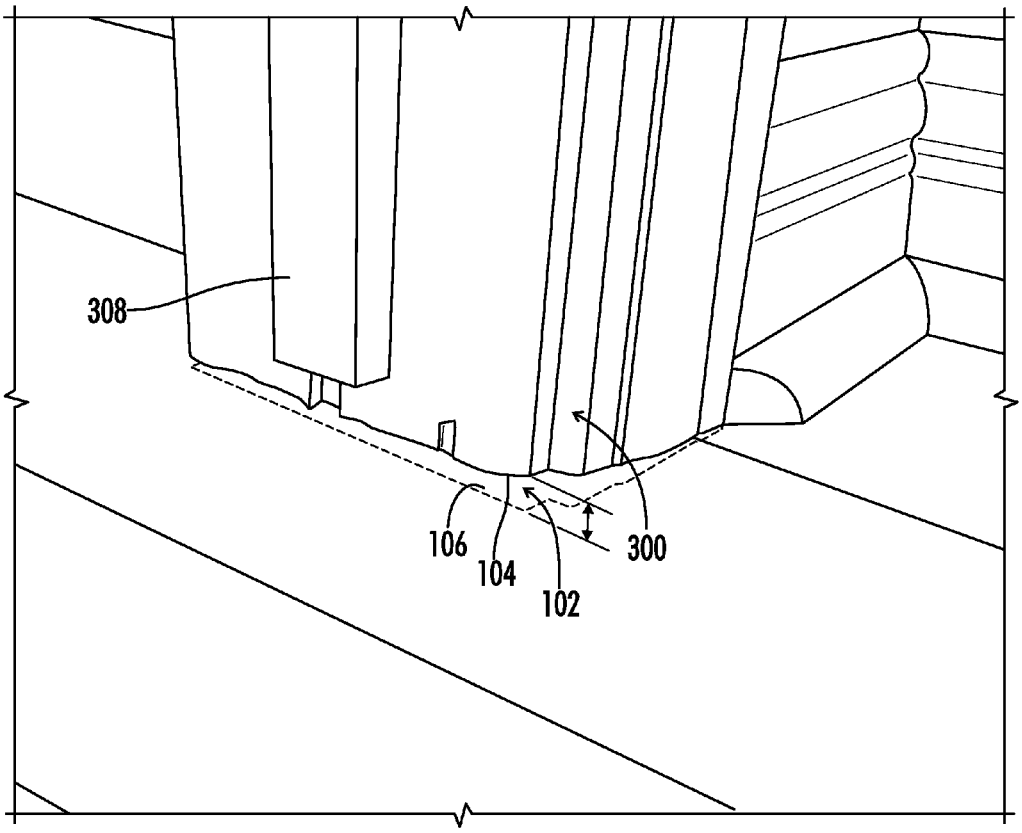
FIG. 5 is an isometric view of a door trim with a door stop cut during installation of the door trim floor gap system.
Figure 6:
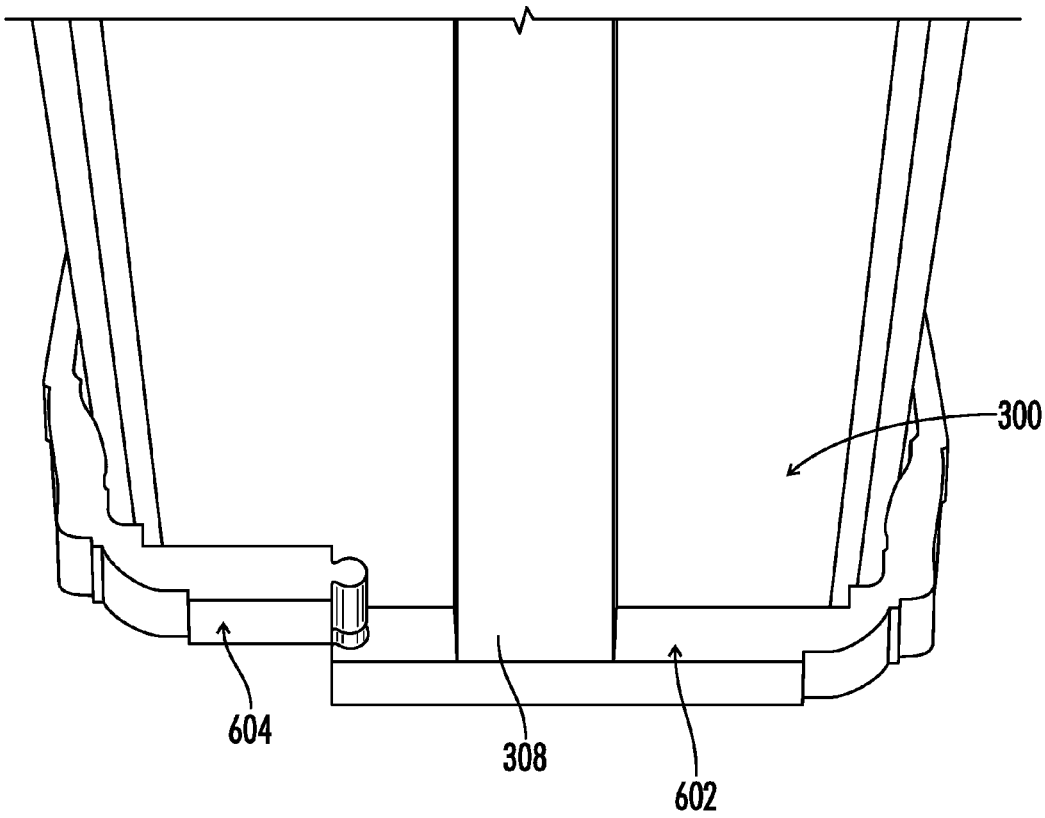
FIG. 6 is an elevated perspective view of a door trim and door trim floor gap system during installation.
Figure 7:
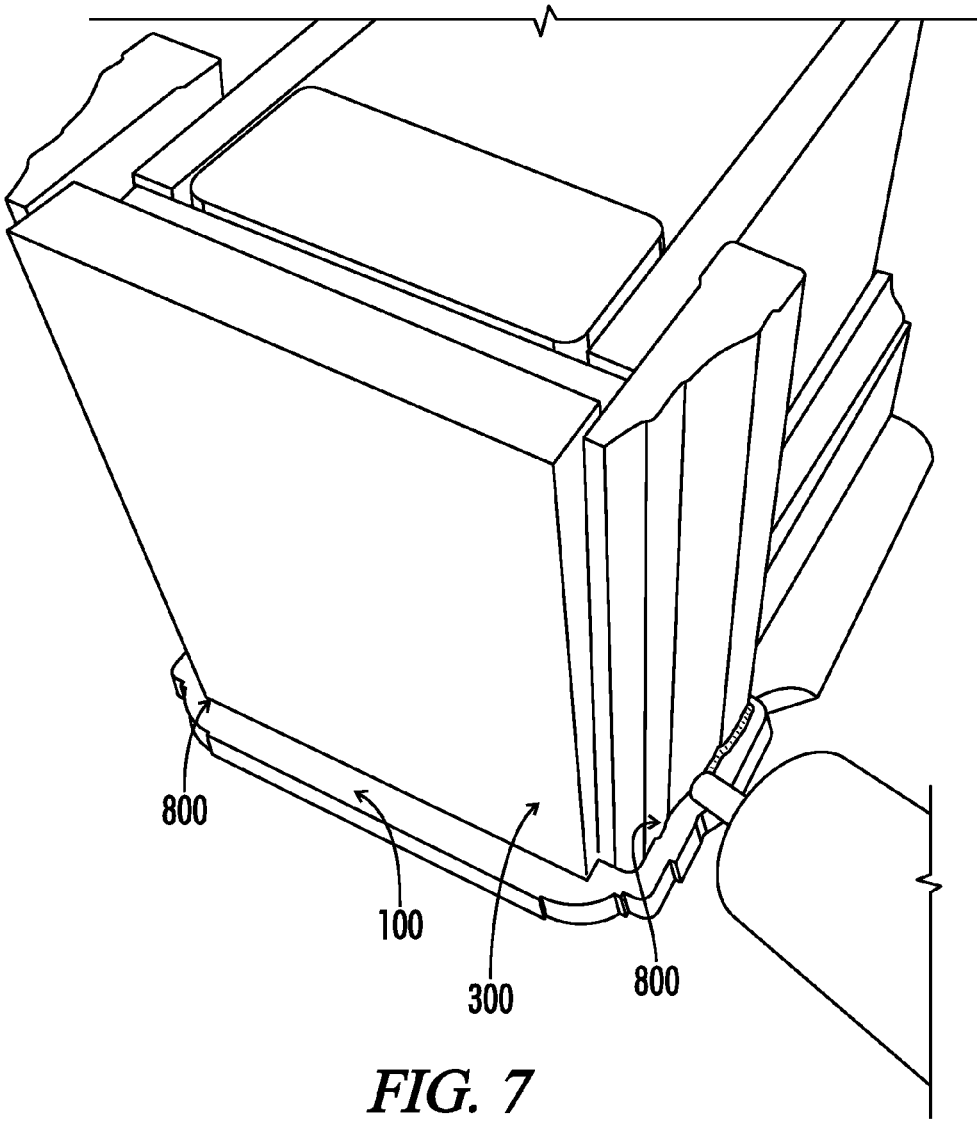
FIG. 7 is an isometric view of a door trim and door trim floor gap system being caulked.

Referring to FIGS. 5-7, a method of installing the door trim floor cover system 100 on the door trim 300 to cover the gap 102 between the bottom 104 of the door trim 300 and the walking surface 106 of the flooring material under the door trim 300 includes positioning the inner face 702 of the first interlocking section 602 against the outer face 320 of the jamb 306 such that the inner face 702 of the first longitudinal portion 402 contacts the outer face 314 of the first casing 302, a bottom of the first interlocking section 602 contacts the walking surface 106 of the foreign material, and the first book 406 engages the distal face 312 of the first casing 302. An inner face 704 of the second interlocking section 604 is positioned against the outer face 320 of the jamb 306 of the door trim 300 such that the inner face 704 of the second longitudinal portion 404 contacts the outer face 326 of the second casing 304, and the second interlocking section 604 is not in contact with the walking surface 106 of the foreign material (see FIG. 6). The second interlocking section 604 is been lowered to the walking surface 106 of the foreign material such that the recess 606 and protrusion 610 of the first and second interlocking sections 602, 604 interlock with one another to retain the first hook 406 and second hook 408 in contact with the distal faces of the first and second casings 302, 304. If the door trim 300 includes the doorstop 308, the method includes cutting off the doorstop 308 at a point approximately ⅝" above the walking surface 106 of the foreign material under the door trim 300 (see FIG. 5). In one embodiment, completing installation of the system 100 on the door trim 300 includes caulking a seam 800 formed between the system 100 and the door trim 300. The system 100, door trim 300, and caulk may all then be painted for consistency.

Figure 8:
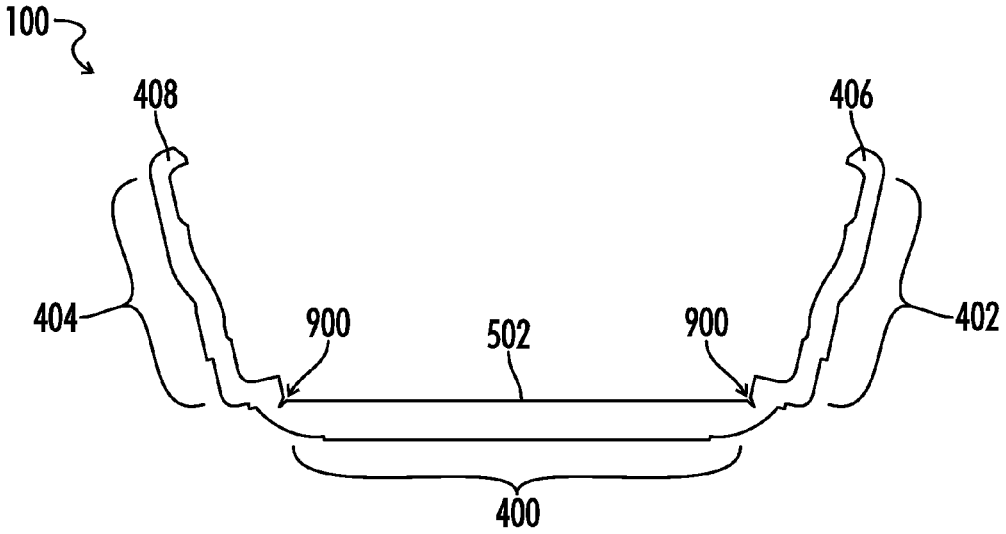
FIG. 8 is a top plan view of a malleable door trim floor gap system.

Referring to FIG. 8, the system 100 is formed from a unitary section of malleable material in one embodiment. In this embodiment, the inner face 502 of the center portion 400 is placed against the outer face 320 of the jamb 306 for installation. The first and second longitudinal portions 402, 404 are then bent toward one other (e.g., forced together via a C-clamp) and into contact with the first and second casings, respectively. Thus, the first and second hooks 406, 408 engage the distal faces of the first and second casings, respectively. In this embodiment, the system 100 optionally includes bending points 900 at the junctions between first and second longitudinal portions 402, 404. The bending points 900 act as stress points that collapse when the first and second longitudinal portions 402, 404 are forced together, preventing pending of the first and second longitudinal portions and ensuring a proper installation with the system 100 fitted to the door trim 300.

In one embodiment, the system 100 is formed from a unitary section of resilient material. During installation, the first and second longitudinal portions 402, 404 are temporarily pulled away from one another (i.e., spread apart) to enable the inner face 502 of the center portion 400 to be placed against the outer face 320 of the jamb 306. When the first and second longitudinal portions 402, 404 are released, the resilient material resumes its original shape, forcing the first and second hooks into contact with the distal faces of the first and second longitudinal portions, respectively.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful DOOR TRIM FLOOR GAP COVER SYSTEM it is not intended that such references be construed as limitations upon the scope of this invention except as set forth in the following claims.

What is claimed is:

1. A door trim floor gap cover system configured to cover a gap between a bottom of a door trim and a walking surface of a flooring material under the door trim when installed on the door trim, said system comprising:

a center portion extending laterally, wherein the center portion is configured to extend lateral and vertically along an outer face of a jamb of the door trim, wherein the center portion extends further laterally than vertically;

a first longitudinal portion extending generally longitudinally from a first end of the center portion, wherein the first longitudinal portion is configured to extend along an outer face of a first casing of the door trim;

a second longitudinal portion extending generally longitudinally from a second end of the center portion opposite the first end of the center portion, wherein the second longitudinal portion is configured to extend along an outer face of a second casing of the door trim;

a first hook extending longitudinally beyond the first longitudinal portion and generally inward toward the second longitudinal portion such that the first hook engages a distal face of the first casing when the system is installed on the door trim; and a second hook extending longitudinally beyond the second longitudinal portion and generally inward toward the first longitudinal portion such that the second hook engages a distal face of the second casing when the system is installed on the door trim.

2. The system of claim 1, wherein the system comprises a unitary section of resilient material such that the system first and second longitudinal portions may be momentarily spread apart to enable an inner face the center portion to be placed in contact with the outer face of the jamb of the door trim.

3. The system of claim 1, wherein the system comprises a unitary section of malleable material such that when an inner face of the center portion of the system is placed in contact with the outer face of the jamb of the door trim, the first and second longitudinal portions bent toward one another into contact with the first and second casing, respectively, of the door trim such that the first and second hooks engage the distal faces of the first and second casings, respectively.

4. The system of claim 1, wherein the center portion of the system comprises two interlocking sections, each having a lateral edge where the two interlocking sections interlock with one another, and the lateral edges of the two interlocking sections are offset from a center of the center portion by at least ¾".

5. The system of claim 1, wherein the latitudinal and longitudinal directions are substantially horizontal and the center portion of the system comprises:

a first interlocking section having a recess extending vertically through the first interlocking section adjacent a lateral edge of the first interlocking section; and a second interlocking section having a protrusion extending vertically across the second interlocking section from a lateral edge of the second interlocking section, wherein the protrusion is generally complementary to the recess such that the recess is operable to receive the protrusion.

6. The system of claim 1, wherein latitudinal and longitudinal are substantially horizontal, and the system extends vertically approximately ⅝".

7. The system of claim 1, wherein:

the first casing of the door trim has a profile;

the first longitudinal portion has an inner face having a profile generally complementary to the profile of the first casing;

the second casing of the door trim has a profile; and the second longitudinal portion has an inner face having a profile generally complementary to the profile of the second casing.

8. The system of claim 1, wherein:

the first casing of the door trim has a profile;

the first longitudinal portion has an outer face having a profile generally matching the profile of the first casing;

the second casing of the door trim has a profile; and the second longitudinal portion has an outer face having a profile generally matching the profile of the second casing.

9. The system of claim 1, wherein:

the first longitudinal portion is integral with the center portion;

the second longitudinal portion is integral with the center portion;

the first hook is integral with the first longitudinal portion; and the second hook is integral with the second longitudinal portion.

10. The system of claim 1, further comprising:

a first filler section located where the first longitudinal portion meets the center portion, said first filler section configured to abut a first lateral face of the jamb of the door trim and a proximal face of the first casing of the door trim; and a second filler section located where the second longitudinal portion meets the center portion, said second filler section configured to abut a second lateral face of the jamb of the door trim and a proximal face of the second casing of the door trim.

11. A method of installing a door trim floor gap cover system on a door trim to cover a gap between a bottom of the door trim and a walking surface of a flooring material under the door trim, said method comprising:

positioning an inner face of a first interlocking section of a center portion of the system against an outer face of a jamb of the door trim such that an inner face of a first longitudinal portion of the system contacts an outer face of a first casing of the door trim, a bottom of the first interlocking section contacts the walking surface of the flooring material, and a first hook of the system engages a distal face of the first casing, wherein:

the first interlocking section of the center portion has a recess or protrusion adjacent a lateral edge of the first interlocking section;

the center portion extends laterally and vertically when the system is installed on the door trim, the center portion extends further laterally than vertically;

the first longitudinal portion extends generally longitudinally from a first end of the center portion when the system is installed on the door trim;

the first longitudinal portion is configured to extend along the outer face of the first casing of the door trim when the system is installed on the door trim; and the first hook extends longitudinally beyond the first longitudinal portion and generally toward a second longitudinal portion of the system when the system is installed on the door trim; and positioning an inner face of a second interlocking section of the center portion of the system against the outer face of the jamb of the door trim such that an inner face of the second longitudinal portion of the system contacts an outer face of a second casing of the door trim, a second hook of the system engages a distal face of the second casing, and the second interlocking section is not in contact with the walking surface of the flooring material, wherein:

the second interlocking section of the center portion has a recess or protrusion adjacent a lateral edge of the second interlocking section and the recess or protrusion of the second interlocking section is substantially complementary to the recess or protrusion of the first interlocking section;

the second longitudinal portion extends generally longitudinally from a second end of the center portion when the system is installed on the door trim;

the second longitudinal portion is configured to extend along the outer face of the second casing of the door trim when the system is installed on the door trim; and the second hook extends generally longitudinally beyond the first longitudinal portion and generally toward the first longitudinal portion of the system when the system is installed on the door trim; and lowering the second interlocking section to the walking surface of the flooring material such that the recess or protrusion of the first interlocking section interlocks with the complementary recess or protrusion of the second interlocking section.

12. The method of claim 11, further comprising:

cutting off a doorstop of the door trim at approximately ⅝" above the walking surface of the flooring material under the door trim.

13. The method of claim 11, further comprising:

caulking a seam formed between the system and the door trim.

* * * * *